US007530314B2

(12) United States Patent
Skinner et al.

(10) Patent No.: US 7,530,314 B2
(45) Date of Patent: May 12, 2009

(54) THERMALLY INITIATED VENTING SYSTEM AND METHOD OF USING SAME

(75) Inventors: Anthony T. Skinner, Duncanville, TX (US); Michael L. Fortner, Bedford, TX (US); Marcus J. Dill, Hurst, TX (US); David N. Zichichi, Arlington, TX (US); Lamar R. Lunsford, Fort Worth, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 123 days.

(21) Appl. No.: 11/128,578

(22) Filed: May 13, 2005

(65) Prior Publication Data

US 2007/0240600 A1 Oct. 18, 2007

Related U.S. Application Data

(60) Provisional application No. 60/574,105, filed on May 25, 2004.

(51) Int. Cl.
*F42B 15/36* (2006.01)
*F02K 9/38* (2006.01)

(52) U.S. Cl. ..... 102/378; 60/254

(58) Field of Classification Search ..... 102/374, 102/378, 481; 60/223, 253, 254
See application file for complete search history.

(56) References Cited

U.S. PATENT DOCUMENTS

| | | | | |
|---|---|---|---|---|
| 3,180,264 A | | 4/1965 | Armstrong | 102/49 |
| 3,212,439 A | | 10/1965 | Reyne | 102/28 |
| 3,238,873 A | * | 3/1966 | Allen | 102/275.4 |
| 4,597,261 A | | 7/1986 | Dolan | 60/223 |
| 5,035,756 A | | 7/1991 | Covino | 149/37 |
| 5,129,326 A | * | 7/1992 | Brogan | 102/481 |
| 5,166,468 A | * | 11/1992 | Atkeson | 102/207 |
| 5,206,456 A | | 4/1993 | Pracchia et al. | 102/207 |
| 5,385,098 A | | 1/1995 | Lindqvist et al. | 102/205 |
| 5,786,544 A | * | 7/1998 | Gill et al. | 102/481 |
| 5,813,219 A | * | 9/1998 | Gill et al. | 60/223 |
| 6,363,855 B1 | | 4/2002 | Kim et al. | 102/481 |
| 2002/0020323 A1 | | 2/2002 | Dassis | 102/481 |

FOREIGN PATENT DOCUMENTS

FR 2 608 265 A1 6/1988

* cited by examiner

*Primary Examiner*—Bret Hayes
(74) *Attorney, Agent, or Firm*—Daren C. Davis; James E. Walton

(57) ABSTRACT

An apparatus includes a thermally-activated, deflagration initiation device, a deflagration-to-detonation transition manifold, a first transfer line connecting the deflagration initiation device and the deflagration-to-detonation transition manifold, and a linear shaped charge coupled with the first transfer line. An apparatus includes a heat-to-detonation transition manifold, a heat pipe connected to the transition manifold, a linear shaped charge, and a transfer line connecting the heat-to-detonation transition manifold and the linear shaped charge. An apparatus includes a thermally-activated pyrotechnic train and a linear shaped charge coupled with the pyrotechnic train. A method includes initiating a deflagrating material at a predetermined temperature or within a predetermined range of temperatures, initiating a detonating material with the deflagrating material, and initiating a linear shaped charge with the detonated material.

21 Claims, 10 Drawing Sheets

FIG. 12
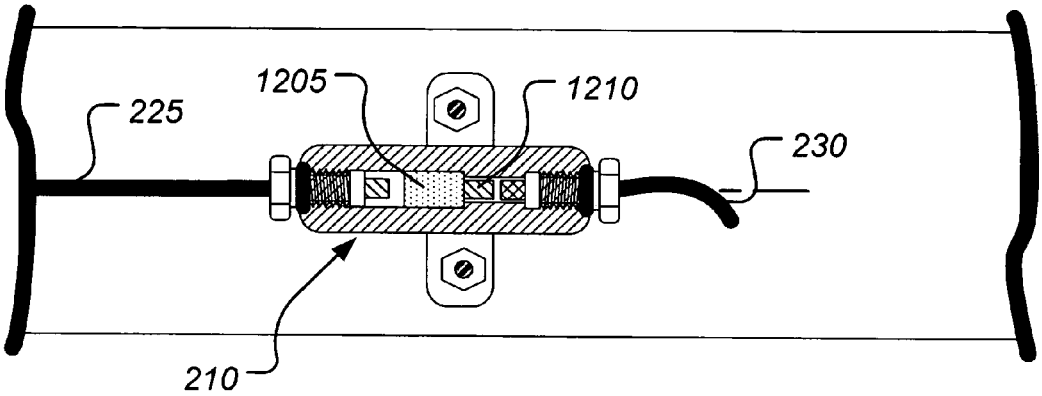
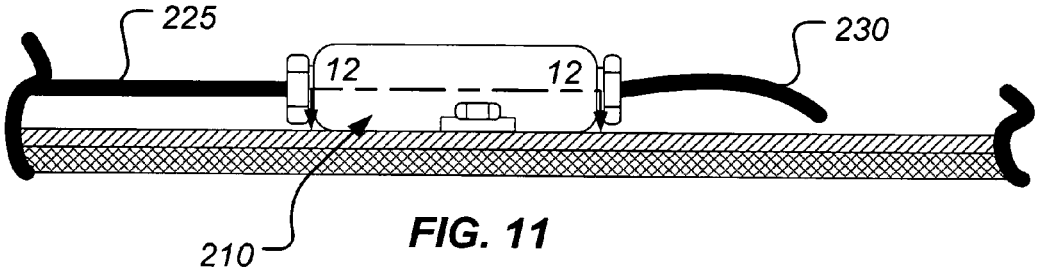
FIG. 11
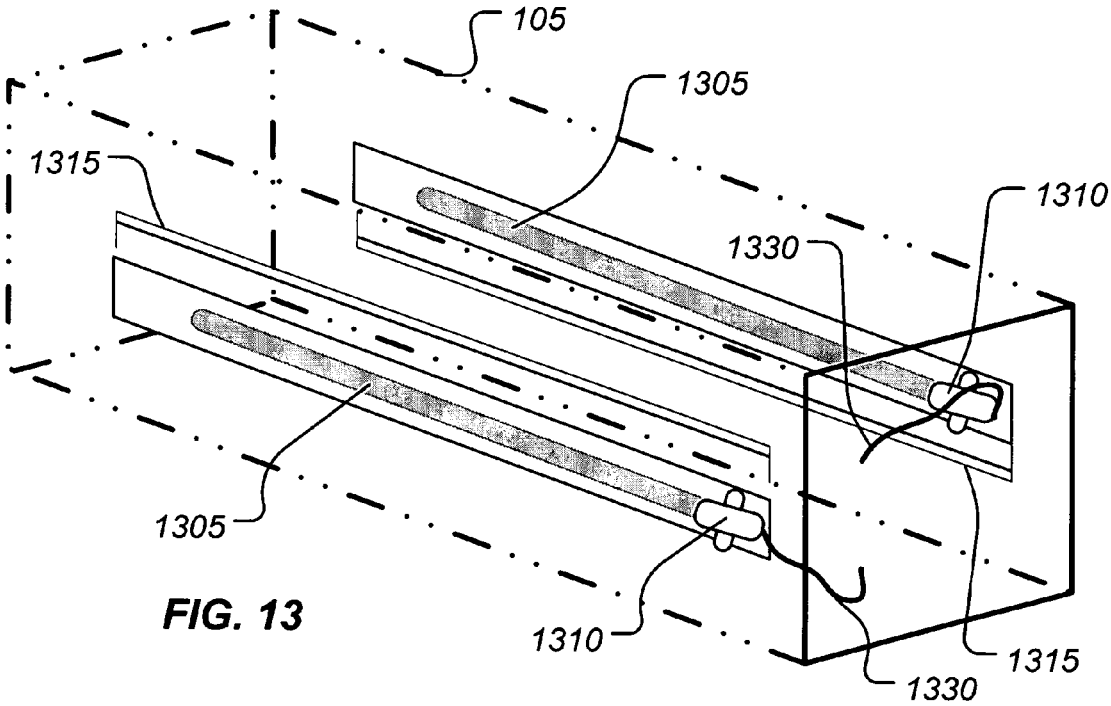
FIG. 13

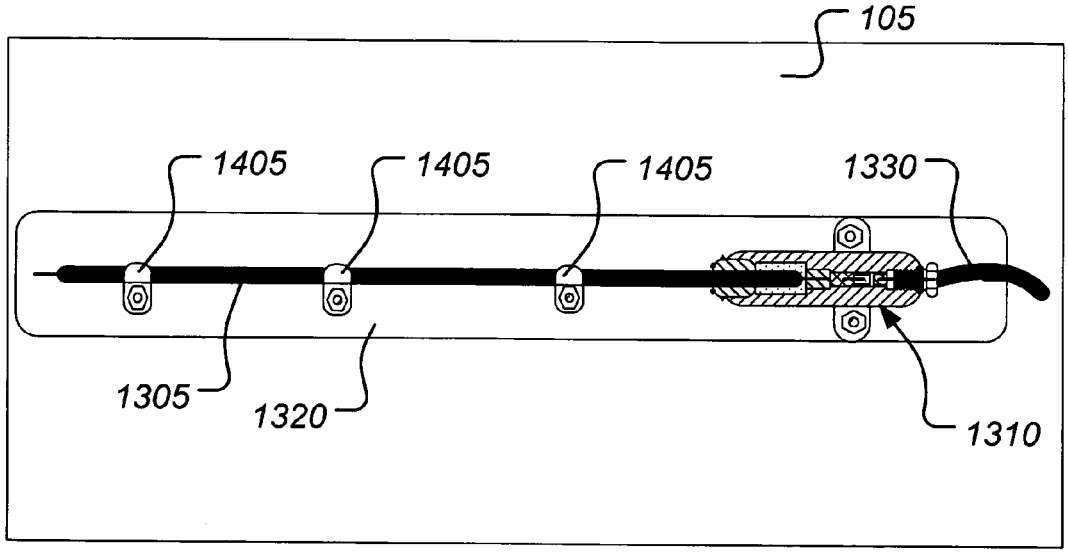
FIG. 14
FIG. 16
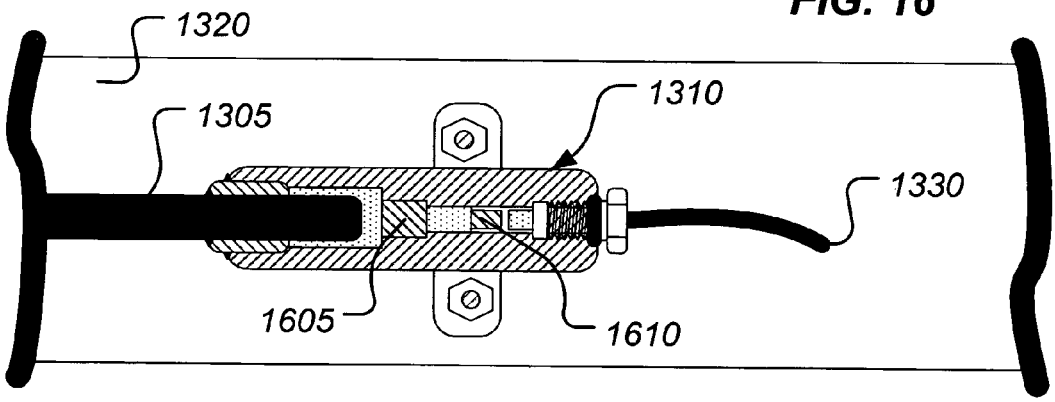
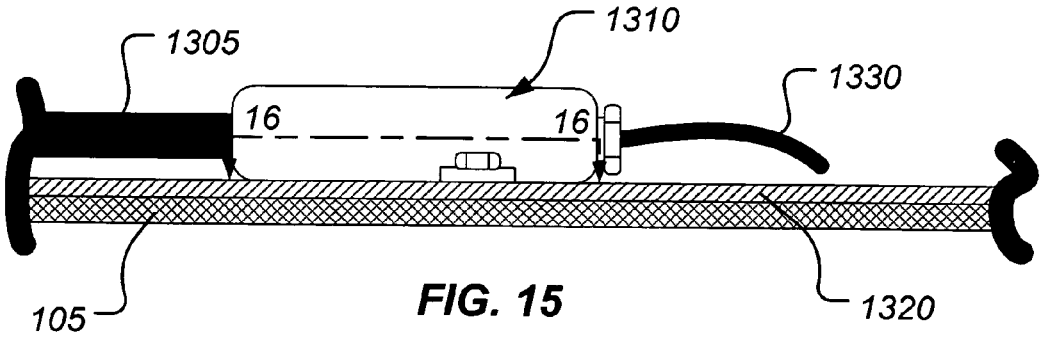
FIG. 15

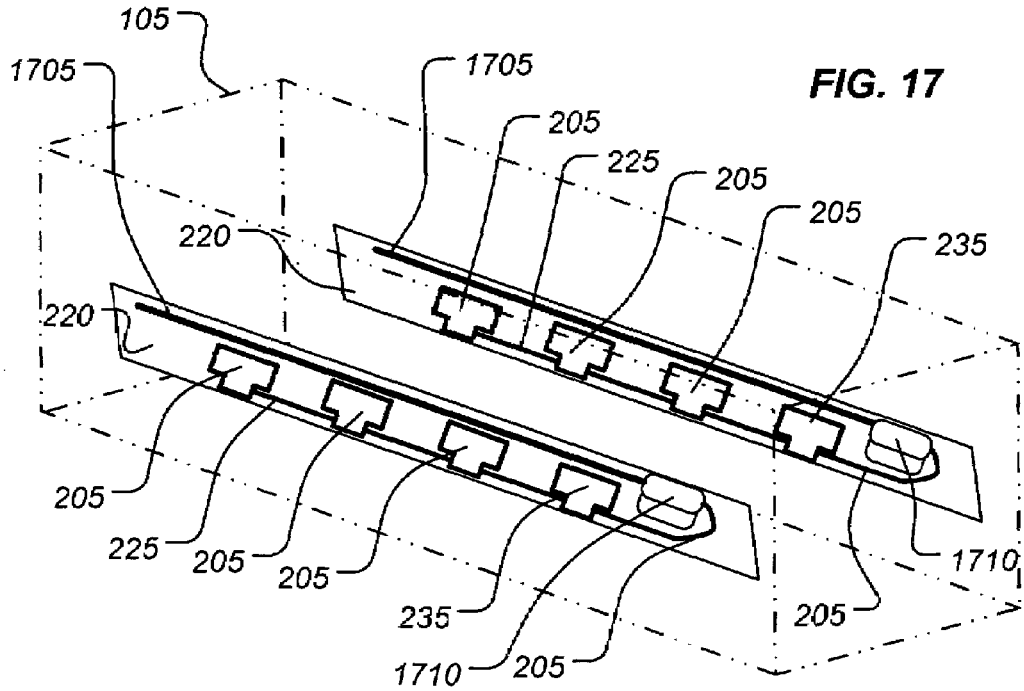
FIG. 17
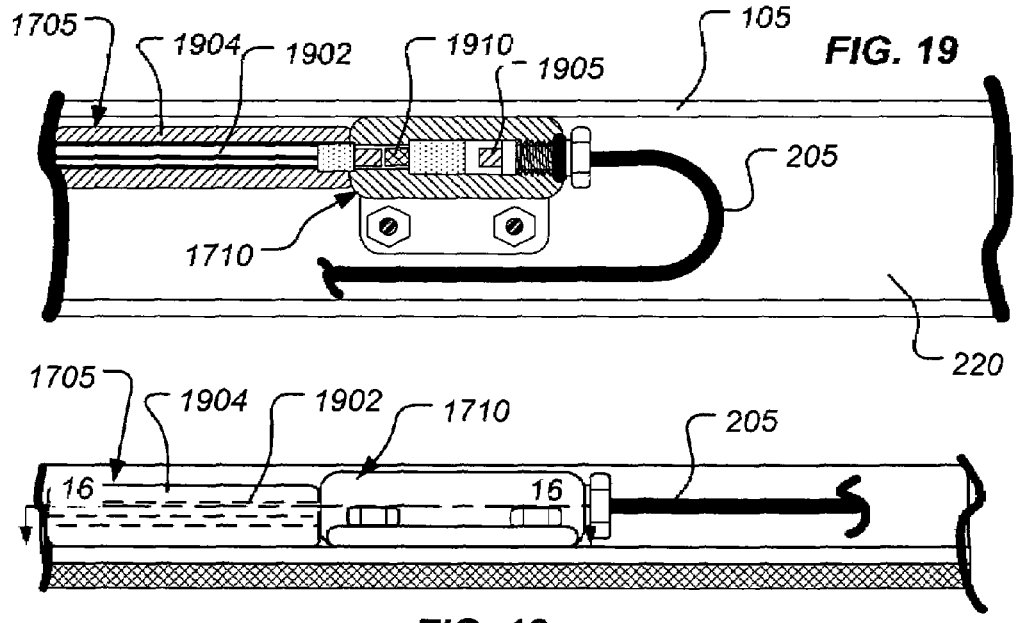
FIG. 19
FIG. 18

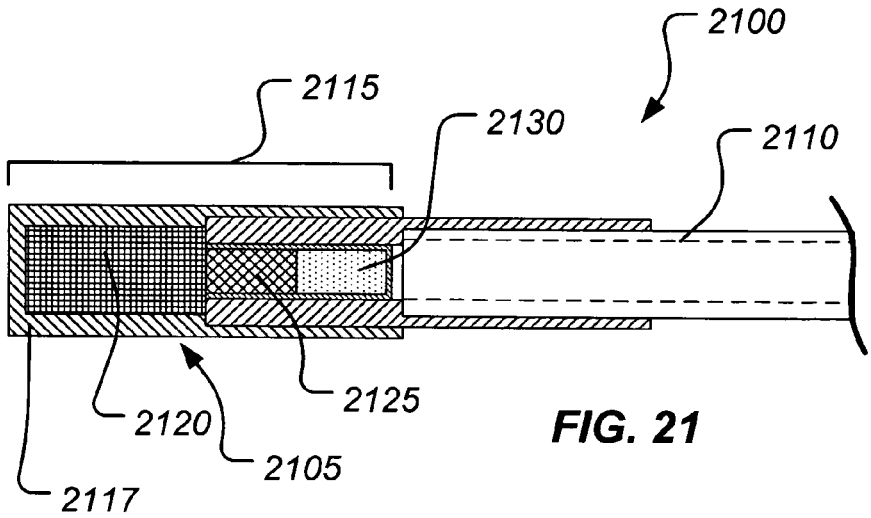
FIG. 21
FIG. 22
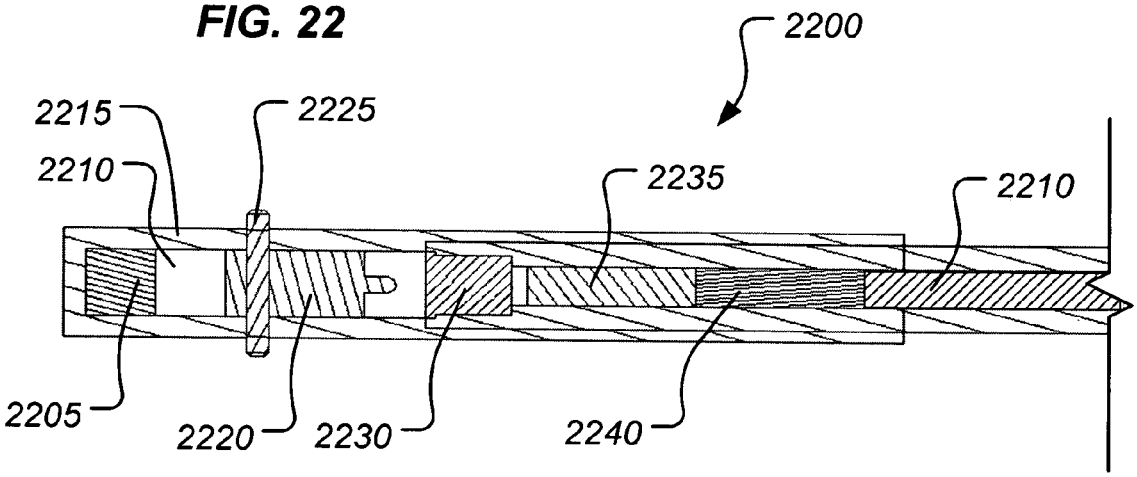

THERMALLY INITIATED VENTING SYSTEM AND METHOD OF USING SAME

CROSS-REFERENCE TO RELATED APPLICATIONS

This application claims the benefit of U.S. Provisional Application No. 60/574,105, filed 25 May 2004, entitled "Thermally Initiated Venting System and Method of Using Same."

BACKGROUND

1. Field of the Invention

This invention relates to a method and apparatus for venting containers housing energetic materials. In particular, the invention relates to a thermally initiated venting system and a method of using same.

2. Description of Related Art

Energetic materials, such as explosives and propellants, are often found in confined spaces within munitions. Under normal conditions, these materials are unlikely to explode or burn spontaneously; however, many are sensitive to heat and mechanical shock. For example, when exposed to extreme heat (as from a fire) or when impacted by bullets or fragments from other munitions, the energetic materials may be initiated, causing the munitions in which they are disposed to inadvertently explode prematurely.

Efforts have been made to develop "insensitive munitions," which are munitions that are generally incapable of detonation except in its intended mission to destroy a target. In other words, if fragments from an explosion strike an insensitive munition, if a bullet impacts the munition, or if the munition is in close proximity to a target that is hit, it is less likely that the munition will detonate. Similarly, if the munition is exposed to extreme temperatures, as from a fire, the munition will likely only burn, rather than explode.

One way that munitions have been made more insensitive is by developing new explosives and propellants that are less likely to be initiated by heating and/or inadvertent impact. Such materials, however, are typically less energetic and, thus, may be less capable of performing their intended task. For example, a less energetic explosive may be less capable of destroying a desired target than a more energetic explosive. As another example, a less energetic propellant may produce less thrust than a more energetic propellant, thus reducing the speed and/or the range of the munition. Additionally, the cost to verify and/or qualify new explosives and/or propellants, from inception through arena and system-level testing, can be substantial when compared to improving the insensitive munition compliance of existing explosives and/or propellants.

The present invention is directed to overcoming, or at least reducing, the effects of one or more of the problems set forth above.

SUMMARY OF THE INVENTION

In one aspect of the present invention, an apparatus is provided. The apparatus includes a thermally-activated, deflagration initiation device, a deflagration-to-detonation transition manifold, a first transfer line connecting the deflagration initiation device and the deflagration-to-detonation transition manifold, and a linear shaped charge coupled with the first transfer line.

In another aspect of the present invention, an apparatus is provided. The apparatus includes a heat-to-detonation transition manifold, a heat pipe connected to the transition manifold, a linear shaped charge, and a transfer line connecting the heat-to-detonation transition manifold and the linear shaped charge.

In yet another aspect of the present invention, an apparatus is provided. The apparatus includes a thermally-activated pyrotechnic train and a linear shaped charge coupled with the pyrotechnic train.

In another aspect of the present invention, a method is provided. The method includes initiating a deflagrating material at a predetermined temperature or within a predetermined range of temperatures, initiating a detonating material with the deflagrating material, and initiating a linear shaped charge with the detonated material.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

FIG. 11 is an elevational view of the transition manifold of FIG. 2;

FIG. 12 is a partial, cross-sectional view of the transition manifold of FIG. 11 taken along the line 12-12 of FIG. 11;

FIG. 13 is a stylized, perspective view of a portion of a second embodiment of a thermally initiated venting system according to the present invention;

FIG. 14 is a plan view of a portion of the thermally initiated venting system of FIG.13;

FIG. 15 is an enlarged, elevational view of one implementation of the transition manifold of FIG. 14;

FIG. 16 is a partial, cross-sectional view of the transition manifold of FIG. 15 taken along the line 16-16 of FIG. 15;

FIG. 17 is a stylized, perspective view of a third embodiment of a portion of a thermally initiated venting system according to the present invention;

FIG. 18 is an elevational view of one of the transition manifolds of FIG. 17;

FIG. 19 is a partial, cross-sectional view of the transition manifold of FIG. 18 taken along the line 19-19 in FIG. 18;

FIG. 21 is a cross-sectional view of a fourth embodiment of a thermally initiated venting system according to the present invention; and FIG. 22 is a cross-sectional view of a fifth embodiment of a thermally initiated venting system according to the present invention.

Figure 1:
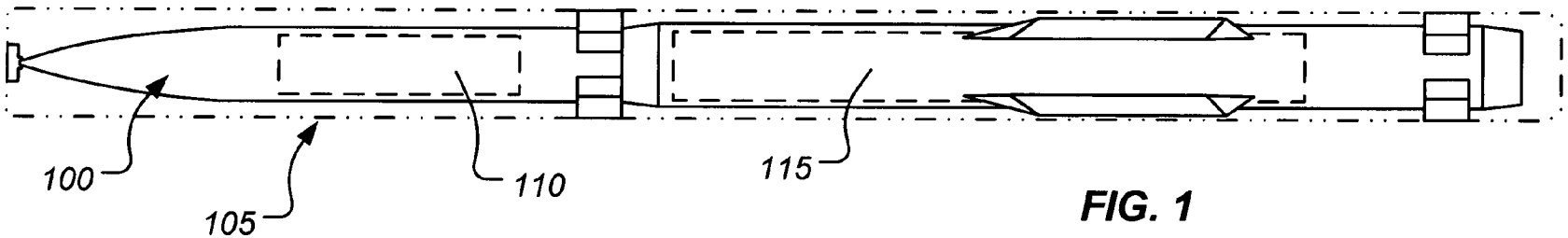
FIG. 1 is a stylized, elevational view of a munition contained within a canister.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention relates to an apparatus for selectively venting a container in which an energetic material is disposed at a predetermined temperature or within a predetermined range of temperatures. For the purpose of this disclosure, an energetic material is defined as a material that, when subjected to a given amount of stimulating energy, reacts by producing a great deal more energy. Such materials, when confined within a container, may explode when heated. Examples of such energetic materials are propellants, explosives, pyrotechnic materials, and detonation initiation substances, although this list is neither exclusive nor exhaustive. The present invention seeks to inhibit inadvertent detonation or deflagration of confined energetic material as a result of heating by venting the container in which the energetic material is contained.

Many devices and systems incorporate energetic materials. Examples of such devices include, but are not limited to, munitions (e.g., missiles, rockets, bombs, and ballistic rounds), oilfield explosives (e.g., downhole perforating charges), airbags (e.g., automobile airbags), and containerized liquid or gelled explosives (e.g., those used in underground and underwater mining and/or demolition). The present invention is described below in conjunction with a munition; however, the present invention is not so limited. Rather, the scope of the present invention encompasses its use in conjunction with various devices and systems that incorporate energetic material, such as those listed above. Note that this list is exemplary, and is neither exhaustive nor exclusive.

FIG. 1 provides a stylized elevational view of a munition 100 contained within a canister 105 (shown in phantom). Such canisters may be used, for example, to protect the munition 100 during shipment or to house the munition 100 prior to launch. The type of canister 105, however, is immaterial to the practice of the present invention. Disposed within the illustrated munition 100 are energetic materials, specifically an explosive 110 and a propellant 115. The shapes, forms, and locations of the energetic materials 110, 115 illustrated in FIG. 1 are merely exemplary. The energetic materials 110, 115 may take on any number of shapes or forms and be disposed at various locations within the munition 100, depending upon the design of the munition 100.

As described in more detail below, the present invention selectively vents the munition 100 proximate the explosive 110 and/or the propellant 115 at a predetermined temperature or within a predetermined range of temperatures. The venting relieves pressure within the munition 100, induced by heating, to inhibit inadvertent detonation of the explosive 110 and/or the propellant 115.

FIG. 2-FIG. 22 illustrate various embodiments of a thermally initiated venting system, according to the present invention. FIG. 2-FIG. 12 illustrate a first embodiment of a thermally initiated venting system according to the present invention, wherein thermal sensing and venting initiation devices are attached to the canister 105 and a venting device is incorporated into the munition 100. FIG. 13-FIG. 16 illustrate a second embodiment of a thermally initiated venting system according to the present invention that incorporates a heat pipe. FIG. 17-FIG. 20 illustrate a third embodiment of a thermally initiated venting system according to the present invention, wherein the thermal sensing, venting initiation, and venting devices are attached to the canister 105. FIG. 21-FIG. 22 illustrate fourth and fifth embodiments, respectively, of a thermally initiated venting system according to the present invention, wherein thermally-activated initiation and detonation capabilities are incorporated into single devices.

Figure 2:
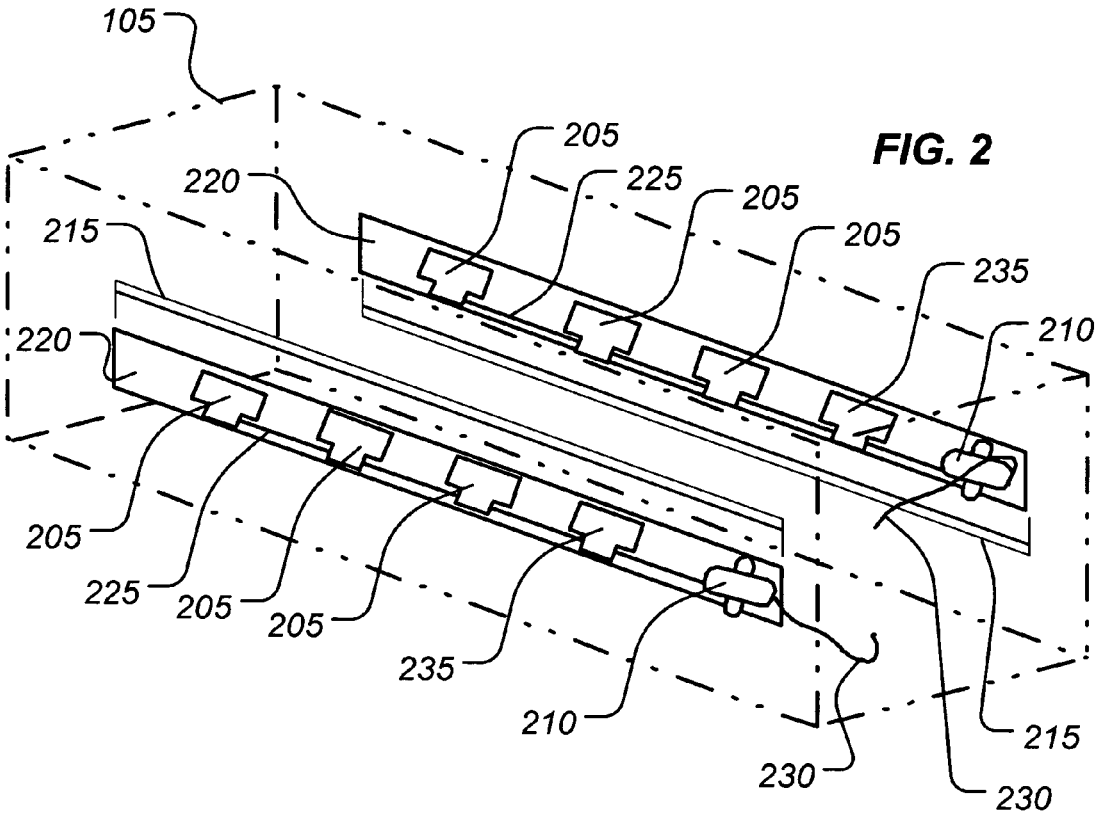
FIG. 2 is a stylized, perspective view of a portion of a first embodiment of a thermally initiated venting system according to the present invention.

FIG. 2 provides a perspective view of a first embodiment of the present invention in conjunction with a portion of the canister 105 proximate the propellant 115 (shown in FIG. 1). In the illustrated embodiment, one or more thermally-activated, deflagration initiation devices 205 and one or more deflagration-to-detonation transition manifolds 210 are attached to the canister 105 in two sets 215 via brackets 220. In alternative embodiments, however, the brackets 220 may be omitted in favor of attaching the initiation devices 205 and the transition manifolds 210 directly to the canister 105. In each of the sets 215, the initiation devices 205 are connected to the transition manifold 210 by a first transfer line 225 (e.g., a rapid deflagrating cord). The transition manifolds 210 are, in turn, connected by second transfer lines 230 (e.g., shielded mild detonating cords) to linear shaped charges (not shown in FIG. 2) disposed in the munition 100. As used herein, the term "linear shaped charge" includes linear shaped charges that have straight or curved forms and may be flexible or rigid.

For the purposes of this disclosure, the term "deflagration" means "an explosive reaction in which the reaction rate is less than the speed of sound in the reacting material." Deflagration differs from burning in that, during deflagration, the reacting material itself supplies oxygen required for the reaction. In burning, oxygen is provided from another source, such as from the atmosphere. Further, the term "detonation" means "an explosive reaction in which the reaction rate is greater than the speed of sound in the reacting material."

Generally, when one of the initiation devices 205 is subjected to heat (e.g., from a bullet impact, a fragment impact, a fire proximate the munition 100, etc.), the temperature of the initiation device 205 rises. When the temperature reaches a predetermined level, a component thereof deflagrates, which, in turn, ignites the first transfer line 225. The deflagration of first transfer line 225, in turn, ignites a charge of the transition manifold 210. Within the transition manifold 210, deflagration is converted to detonation. The detonated transition manifold 210 detonates the second transfer line 230 that, in turn, detonates the linear shaped charge. The linear shaped charges are used to vent the munition 100 as will be more fully described below.

As illustrated in FIG. 2, one or more of the sets 215 may also include one or more disabling, thermally-activated, deflagration initiation devices 235 in embodiments wherein the canister 105 comprises a launch canister. Some embodiments of the present invention (e.g., those used with storage canisters) may alternatively omit the disabling initiation devices 235. The disabling initiation devices 235 are also connected to the transition manifolds 210 via the first transfer line 225. The disabling initiation devices 235 operate similarly to the initiation devices 205. However, they are placed proximate an aft end of the munition 100, such that exhaust gases from the launching munition 100 activate the disabling initiation devices 235. This action activates, and thus disables, the initiation devices 205, the transition manifolds 210, and the first and second transfer lines 225, 230 upon launch of the munition 100, as will be described in greater detail below.

Figure 3:
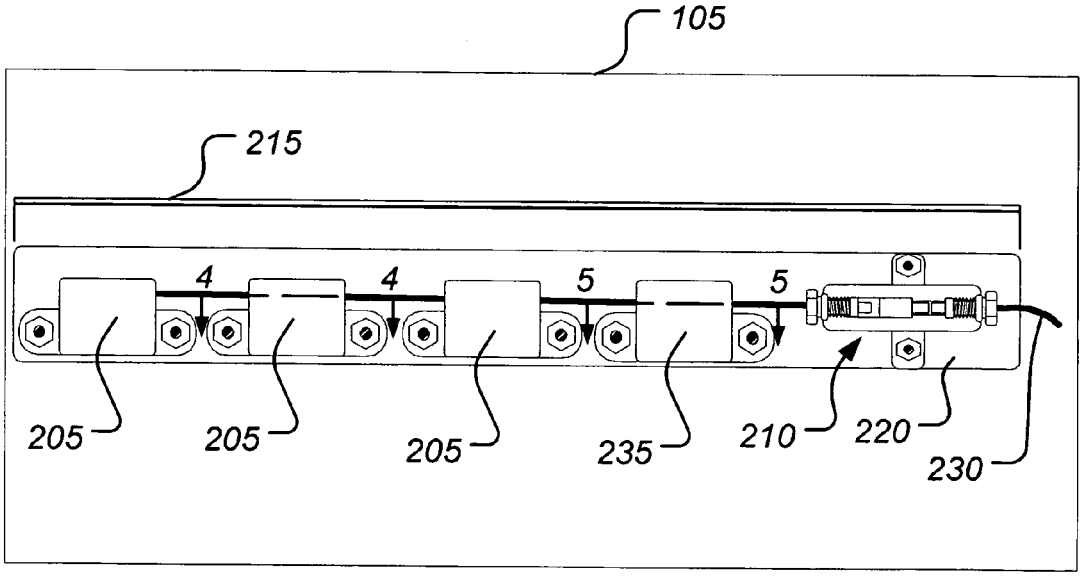
FIG. 3 is an elevational view of a portion of the thermally initiated venting system of FIG. 2.
Figure 4:
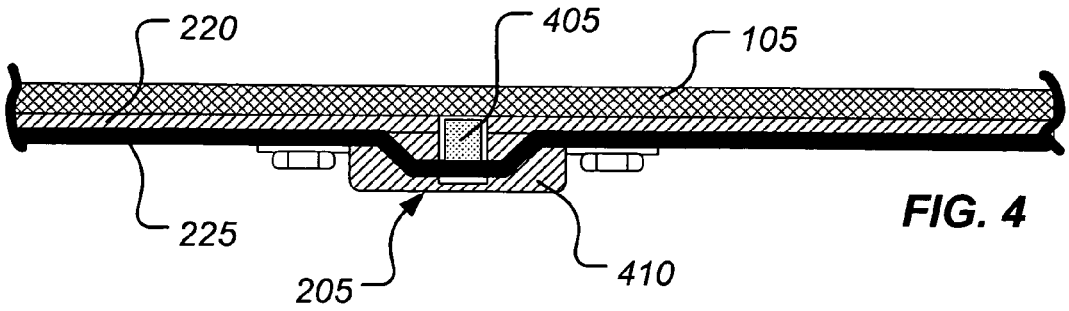
FIG. 4 is a cross-sectional view of an initiation device of FIG. 3 taken along the line 4-4 in FIG. 3.

FIG. 3 illustrates an elevational view of one of the sets 215 of FIG. 2. FIG. 4 provides a cross-sectional view of the initiation devices 205 taken along the line 4-4 of FIG. 3. As shown in FIG. 4, the initiation device 205 comprises a thermally-activated, deflagrating charge 405 disposed within a housing 410. In the illustrated embodiment, the deflagrating charge 405 comprises a combination of rapid deflagrating material and a material that, as it reacts, exhibits an increasing reaction rate, causing the reaction to propagate until the material is consumed. Examples of such combinations include, but are not limited to, $Cs_2B_{12}H_{12}/BKNO_3$, lead azide, hexanitrostilbene (HNS), and ammonium perchlorate. The first transfer line 225 extends through the housing 410 and is in contact with the deflagrating charge 405. In the illustrated embodiment, the first transfer line 225 comprises a rapid deflagrating cord. When activated by heat, the deflagrating charge 405 ignites and, in turn, ignites the first transfer line 225.

Generally, the deflagration charge 405 is inactive below a predetermined propellant safety temperature and is activated above the propellant safety temperature or within a range of temperatures above the propellant safety temperature. In other words, a material is chosen for the deflagrating charge 405 that will spontaneously activate at or above the propellant safety temperature or within a range of temperatures at or above the propellant safety temperature. The propellant safety temperature is a temperature below that at which the propellant 115 will spontaneously ignite and explode (i.e., the "propellant auto-ignition temperature").

For example, if the propellant auto-ignition temperature of the propellant 115 is about 132° C., the propellant safety temperature may be about 93° C. Thus, in this example, the deflagration charge 405, and thus, the initiation device 205, is activated at a temperature above about 93° C. Alternatively, the deflagration charge 405 may be activated within a range of temperatures, e.g., between the propellant safety temperature and a temperature between the propellant safety temperature and the propellant auto-ignition temperature. For example, the deflagration charge 405 and, thus, the initiation device 205, may become active between about 93° C. and about 121° C.

Figure 5:
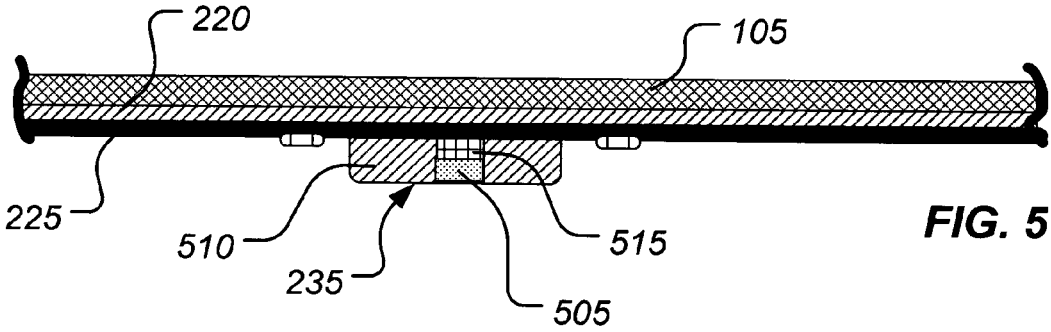
FIG. 5 is cross-sectional view of a disabling initiation device of FIG. 3 taken along the line 5-5 of FIG. 3.

FIG. 5 provides a cross-sectional view of the disabling initiation device 235 taken along the line 5-5 of FIG. 3. The disabling initiation device 235 comprises a thermally-activated, deflagrating charge 505 disposed within a housing 510. In various embodiments, the deflagrating charge 505 may comprise one of the materials used for the deflagrating charge 405 (shown in FIG. 4). The first transfer line 225 extends through the housing 510. In embodiments wherein the canister 105 comprises a launch canister, the disabling initiation device 235 is used to disable the initiation devices 205 and the transition manifolds 210 upon launching the munition 100. In this way, the canister 105 is rendered inert after launch of the munition 100, as the deflagrating and detonating materials of the initiation devices 205, the transition manifolds 210, and the first and second transfer lines 225, 230 are activated and spent.

In the illustrated embodiment, a pyrotechnic delaying portion 515 is disposed within the housing and between the deflagrating charge 505 and the first transfer line 225. The pyrotechnic delaying portion 515 may, in various embodiments, comprise materials such as tungsten or other such slow-burning reaction material. When the deflagrating charge 505 is activated, the pyrotechnic delaying portion 515 delays the activation of the first transfer line 225 by the burning deflagrating charge 505. In this way, the linear shaped charges (not shown in FIG. 5) may become disconnected from the initiating devices 205, 235 (as will be discussed in greater detail below) and the munition 100 may be launched from the canister 105 prior to the initiation devices 205, the transition manifolds 210, and the first and second transfer lines 225, 230 being disabled. Premature activation of the disabling initiation devices 235 would initiate the linear shaped charges, thus venting the munition 100 and rendering it unusable.

Generally, the deflagrating charge 505 is inactive below a predetermined temperature below a minimum munition exhaust temperature and is activated above the predetermined temperature or within a range of temperatures below the minimum munition exhaust temperature. In other words, a material is chosen for the deflagrating charge 505 that will spontaneously activate above the predetermined temperature (i.e., below the minimum munition exhaust temperature) or within a range of temperatures below the minimum munition exhaust temperature. The minimum munition exhaust temperature is the lowest temperature produced by the munition 100's exhaust when launched and is highly dependent upon the configuration of the munition 100.

For example, the munition 100's minimum exhaust temperature may be about 2500° C. However, the exhaust is present within the canister 105 only for a short amount of time when the munition 100 is launched. As a result, the temperature of the disabling initiation device 235 may likely not reach the minimum exhaust temperature but, rather, will increase to a temperature below the minimum exhaust temperature. Thus, in this example, the deflagration charge 505, and thus, the disabling initiation device 235, is activated at a temperature above about 95° C. Alternatively, the deflagration charge 505 may be activated within a range of temperatures, e.g., between the minimum munition exhaust temperature and a maximum munition exhaust temperature. For example, the deflagration charge 505 and, thus, the disabling initiation device 235, may become active between about 95° C. and about 200° C.

Figure 6:
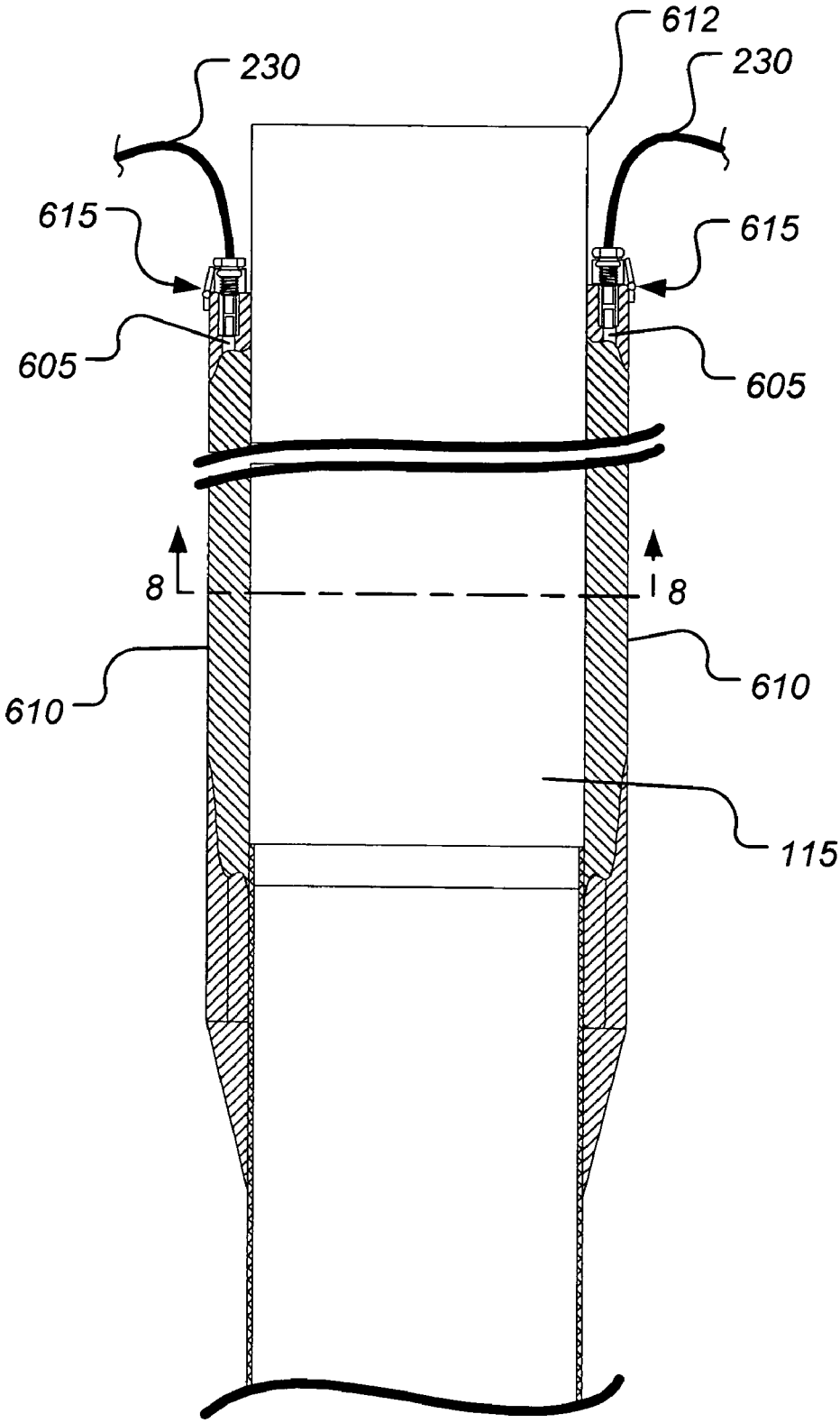
FIG. 6 is cross-sectional view of a portion of one implementation of the munition of FIG. 1.

FIG. 6 provides a cross-sectional view of a portion of an embodiment of the munition 100 according to the present invention. In the illustrated embodiment, linear shaped charges 605 are disposed within a wireway 610 proximate the propellant 115 and mounted to a case 612 surrounding the propellant 115. Release joints 615 interconnect the second transfer lines 230 and the linear shaped charges 605. When the second transfer lines 230 are detonated by the transition manifolds 210, the detonation propagates through the second transfer lines 230 to the release joints 615. The detonation is further propagated through the release joints 615 to the linear shaped charges 605.

Figure 7:
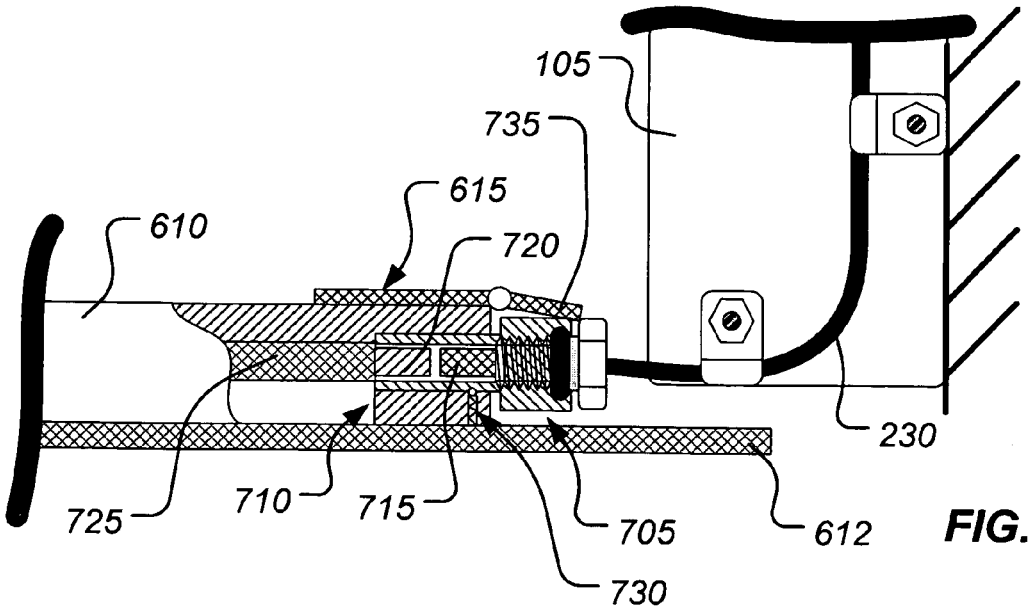
FIG. 7 is an enlarged view of one of the release joints of FIG. 6.

FIG. 7 provides an enlarged view of one of the release joints 615 of FIG. 6. In the illustrated embodiment, the release joint 615 comprises an inner portion 705 and an outer portion 710. The second transfer line 230 is received in the inner portion 705 and contacts a detonating cord booster 715, which is disposed in the male portion 705. In various embodiments, the booster 715 may comprise materials such as, but not limited to, CH-6 explosive, which is a mixture of cyclotrimethylene trinitramine (RDX), graphite, calcium stearate and polyisobutylene. An acceptor 720 is disposed within the male portion 705 and proximate the booster 715. In various embodiments, the acceptor 720 may comprise materials such as, but not limited to, CH-6 (e.g., a higher density form of CH-6 than that of the booster 715) and HNS. The acceptor 702 contacts the linear shaped charge 605.

In the illustrated embodiment, the booster 715 comprises a more energetic material than the second transfer line 230, and the acceptor 720 comprises a more energetic material than the booster 715. Thus, the detonation wave produced by the detonated second transfer line 230 is amplified by the booster 715, and further amplified by the acceptor 720. In this way, a detonation wave of sufficient amplitude to detonate the linear shaped charge 605 is generated.

Still referring to FIG. 7, the male portion 705 of the release joint 615 slides into the outer portion 710 and is retained therein by a retainer 730. In the illustrated embodiment, the retainer 730 comprises a ball and spring disposed in a bore (not labeled for clarity) of the outer portion 710. The spring urges the ball into engagement with a corresponding indentation or groove (also not labeled for clarity) in the inner portion 705. However, when the munition 100 is launched, sufficient force is generated to overcome the engagement of the retainer 730 and the inner portion 705. Thus, as the munition 100 is launched, the inner portion 705 is removed from the outer portion 710.

Once the inner portion 705 has been completely removed from the outer portion 710, a door 735, attached to the outer portion 710, closes over the opening to the outer portion 710. The door 735 is biased toward a closed position and is held open only by the presence of the inner portion 705. Thus, with the inner portion 705 removed, the door automatically closes over the opening into the outer portion 710 to inhibit inadvertent detonation of the linear shaped charge 605. While the door 735 is present in the illustrated embodiment, it may be omitted from other embodiments. Further, in some embodiments, the release joint 615 may be omitted, such that the second transfer line 230 is connected directly to the linear shaped charge 605.

Figure 8:
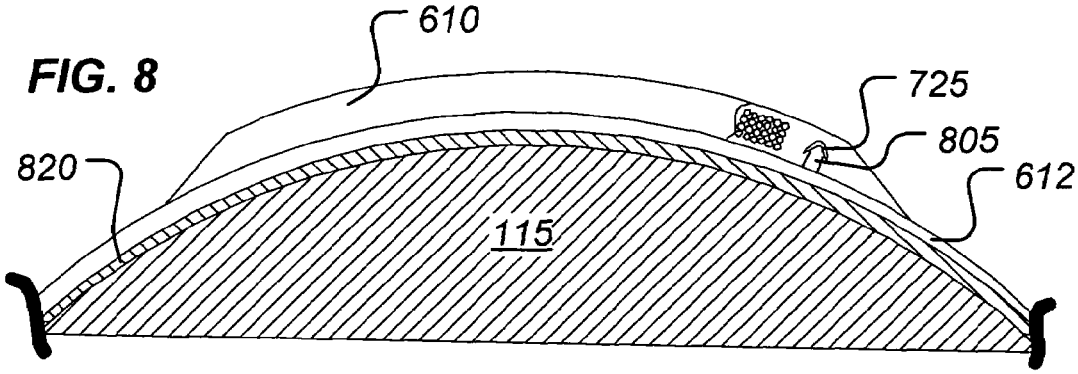
FIG. 8 is a partial, cross-sectional view of the munition of FIG. 6 taken along the line 8-8 in FIG. 6.
Figure 9:
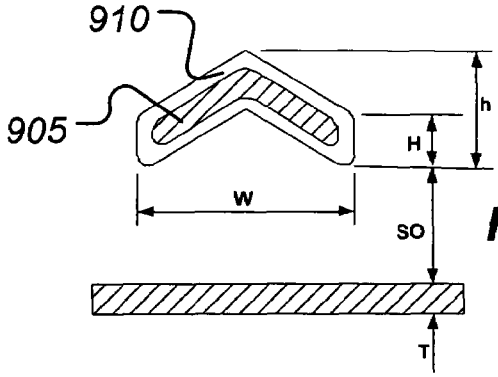
FIG. 9 is an enlarged, cross-sectional view of the linear shaped charge of FIG. 8 illustrating its relationship to the munition.

FIG. 8 provides a partial cross-sectional view of the munition 100 taken along the line 8-8 of FIG. 6. FIG. 9 is an enlarged view of the linear shaped charge 605 and its relationship to the casing 612 surrounding the propellant 115. In the illustrated embodiment, the linear shaped charge 605 comprises a PBXN5 explosive 905 enveloped by a copper sheath 910. The "coreload" of the explosive 905 is about 50 grains per foot. The "coreload" is the explosive core of the linear shaped charge 605, expressed as the weight in grains of explosive per foot. Other explosive materials and sheaths, however, may be used and are encompassed by the present invention. The linear shaped charge 605 is disposed within a cavity 805 such that, when detonated, the jet formed by the detonated charge 605 may travel substantially unimpeded to the case 612. In the embodiment illustrated in FIG. 8, an insulation layer 820 is disposed between the case 612 and the propellant 115.

Referring in particular to the embodiment of FIG. 9, for a case 612 thickness within a range from about 0.14 inches to about 0.23 inches, the overall height (h) of the linear shaped charge 605 is about 0.16 inches and its width (W) is about 0.22 inches. In this example, the leg height (H) of the linear shaped charge 605 is about 0.06 inches. The standoff from the linear shaped charge 605 to the case 612 is about 0.18 inches. The present invention, however, is not limited to this configuration. Rather, the particular dimensions of the linear shaped charge 605 and the standoff between the linear shaped charge 605 and the case 612 will be determined based upon at least the particular explosive 905, the sheath material 910, the material of the case 612, and the thickness of the case 612, as will be appreciated by one of ordinary skill in the art having the benefit of this disclosure.

Figure 10A:
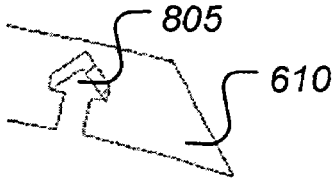
FIG. 10A-FIG. 10C are cross-sectional views illustrating various means for mounting the linear shaped charge of FIG. 8.
Figure 10B:
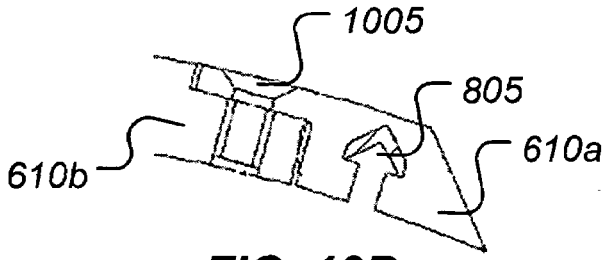
Figure 10C:
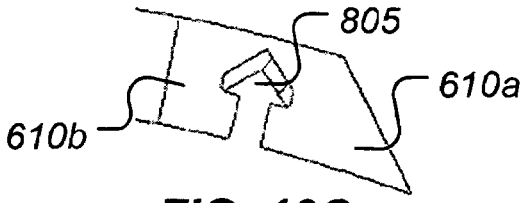

Referring again to FIG. 8, the linear shaped charge 605 may be mounted in the wireway 610 by various means. Examples of various mounting means are illustrated in FIG. 10A-FIG. 10C. As illustrated in FIG. 10A, the cavity 805 may be merely formed, machined, etc. into the wireway 610, such that the wireway 610 comprises a single piece. Alternatively, as illustrated in FIG. 10B, the wireway 610 may comprise two (or more) portions 610*a*, 610*b*, with one of the portions (e.g., portion 610*b*) defining the cavity 805. In this implementation, the portion 610*a* is attached to the portion 610*b* by a fastener 1005. In another alternative implementation, as illustrated in FIG. 10C, the portion 610*b*, which defines the cavity 805, is adhesively bonded to the portion 610*a* and, in certain embodiments, to the case 612.

FIG. 11 is an elevational view of the transition manifold 210. FIG. 12 is a partial, cross-sectional view of the transition manifold 210 taken along the line 12-12 of FIG. 11. The transition manifold 210 comprises a first booster 1205 and a second booster 1210. The first booster 1205 is disposed between the first transfer line 225 and the second booster 1210. The second booster 1210 is disposed between the first booster 1205 and the second transfer line 230. The first booster 1205 and the second booster 1210 may comprise materials such as CH-6 explosive or other high explosives. Generally, the first booster 1205 comprises a material that is more energetic than the material of the first transfer line 225 (e.g., rapid deflagration cord). The second booster 1210 comprises a material that is more energetic than the material of the first booster 1205. In embodiments wherein the boosters 1205, 1210 comprise the same material, the material of the second booster 1210 may be more firmly packed and, thus, have a higher density, than that of the first booster 1205. Thus, the deflagration or burning of the first transfer line 225 is transitioned to a detonation of the second transfer line 230 (e.g., shielded mild detonating cord). While the transition manifold 210 is described herein as having a particular construction, the scope of the present invention includes variations to the described construction depending upon the other components of the thermally initiated venting system.

FIG. 13 illustrates a second embodiment of the present invention in conjunction with a portion of the canister 105 proximate the propellant 115. In the illustrated embodiment, one or more heat pipes 1305 replace the initiation devices 205, the disabling initiation devices 235, and the first transfer line 225 of the first embodiment (shown in FIG. 2-FIG. 12). The one or more heat pipes 1305 and one or more heat-to-detonation transition manifolds 1310 are attached to the canister 105 in two sets 1315 via brackets 1320. In alternative embodiments, however, the brackets 1320 may be omitted in favor of attaching the heat pipes 1305 and the transition manifolds 1310 directly to the canister 105. In each of the sets 1315, the heat pipes 1305 are connected directly to the transition manifold 1310. The transition manifolds 1310 are, in turn, connected by transfer lines 1330 (e.g., shielded mild detonating cords) to linear shaped charges (e.g., the linear shaped charge 605 of FIG. 6-FIG. 9) disposed in the munition 100.

Generally, heat pipes are devices that transfer heat from one point to another. In many embodiments, a heat pipe, e.g., the heat pipe 1305, comprises a sealed tube made from a material exhibiting high thermal conductivity, such as copper or aluminum. A wick is disposed on the inner surface of the tube. The wick often comprises a foam or felt made from materials such as steel, aluminum, nickel, copper, ceramics, and carbon. Alternatively, the wick may comprise a sintered powder, a screen mesh, or merely grooves defined by the inner surface of the tube. A "working fluid", such as ammonia, acetone, methanol, ethanol, water, toluene, or mercury, is disposed within the tube.

In operation, the working fluid, under its own pressure, enters the pores of the wick and wets the interior surfaces of the pores. Applying heat at a point along the surface of the heat pipe causes the liquid at that point to boil and enter a vapor state, picking up the latent heat of vaporization. The gas, which then has a higher pressure, moves inside the sealed tube to a colder location where it condenses. In the embodiment of FIG. 13, the transition manifold 1310 acts as a heat sink; thus, the gas condenses within the tube proximate the transition manifold 1310. As it condenses, the gas gives up the latent heat of vaporization and moves heat from the input (i.e., the point at which heat is applied to the heat pipe 1305) to the output end (i.e., the end of the heat pipe 1305 proximate the transition manifold 1310).

Thus, as the temperature rises proximate the munition 100, some of the heat is absorbed into the heat pipe 1305. The heat is then transferred to the transition manifold 1310. When enough heat has been transferred to raise the temperature of the transition manifold 1310 to its activation temperature, a charge of the transition manifold 1310 will detonate and initiate the transfer line 1330. The transfer line 1330 detonates the linear shaped charge (e.g., the linear shaped charge 605 of FIG. 6-FIG. 9), as described above in relation to the first embodiment.

FIG. 14 provides a plan view of one of the sets 1315. In the illustrated embodiment, the heat pipe 1305 is attached to the bracket 1320 by hangers 1405. The heat pipe 1305 extends into the transition manifold 1310.

FIG. 15 is an enlarged, elevational view of one implementation of the transition manifold 1310. FIG. 16 is a partial cross-sectional view of the transition manifold 1310 taken along the line 16-16 of FIG. 15. The transition manifold 1310 comprises a first booster 1605 and a second booster 1610. The first booster 1605 is disposed between the heat pipe 1305 and the second booster 1610. The second booster 1610 is disposed between the first booster 1605 and the transfer line 1330. The first booster 1605 may comprise materials such as $Cs_2B_{12}H_{12}/BKNO_3$, lead azide, hexanitrostilbene (HNS), and ammonium perchlorate. The second booster 1610 may comprise materials such as CH-6 or other such explosives. Generally, the first booster 1605 comprises a material that is capable of deflagrating at the predetermined temperature or within the predetermined range of temperatures, as discussed above concerning the first embodiment. For example, the first booster 1605 may comprise a material that is initiated at or above the propellant safety temperature or within a range of temperatures at or above the propellant safety temperature.

The second booster 1610 comprises a material that is more energetic than the material of the first booster 1605. Thus, heat transferred from the heat pipe 1305 to the transition manifold 1310 results in a detonation of the transfer line 1330 (e.g., shielded mild detonating cord). The heat pipe 1305 may also be used to transfer heat produced by launching the munition 100 to the transition manifold 1310, thus initiating the transfer line 1330. In this way, the canister 105 is rendered inert after launch of the munition 100, as the detonating materials of the transition manifolds 1310 and the first and second transfer lines 225, 230 are activated and spent, as discussed above concerning the first embodiment.

In some embodiments, initiation of the second booster 1610 may be delayed or retarded by spacing the first booster 1605 away from the second booster 1610, as shown in FIG. 16 to give the munition 100 time to clear the canister 105. In other embodiments, a material, such as a metal/metal oxide, may be disposed between the boosters 1605, 1610 to slow initiation of the second booster 1610.

FIG. 17 provides a perspective view of a third embodiment of the present invention in conjunction with a portion of the canister 105 proximate the propellant 115 (shown in FIG. 1). In the illustrated embodiment, a linear shaped charge assembly 1705 is attached to the canister 105, rather than the linear shaped charge 605 being attached to the munition 100 (as shown in FIG. 6-FIG. 9). In this embodiment, the linear shaped charge (not shown in FIG. 17) extends directly into a deflagration-to-detonation transition manifold 1710, rather than, as in the first embodiment, being connected to the transition manifold 210 by the second transfer line 230. Other aspects of this embodiment correspond to those of the first embodiment.

FIG. 18 provides an elevational view of one of the transition manifolds 1710 connected to the linear shaped charge assembly 1705 and the transfer line 205. FIG. 19 provides a partial, cross-sectional view of the linear shaped charge assembly 1705 and the transition manifold 1710 taken along the line 18-18 of FIG. 18. A linear shaped charge 1902 extends from a holder 1904 and into the transition manifold 1710. The transition manifold 1710 comprises a booster 1905 and an acceptor 1910. The booster 1905 is disposed between the transfer line 205 and the acceptor 1910. The acceptor 1910 is disposed between the booster 1905 and the linear shaped charge 1902. In various embodiments, the booster 1905 and the acceptor 1910 may comprise materials such as, but not limited to, CH-6 or other such explosives. In embodiments wherein the booster 1905 and the acceptor 1910 comprise the same material, the material of the acceptor 1910 may be more firmly packed and, thus, have a higher density, than that of the booster 1905.

Referring again to FIG. 17, the transfer line 225 begins deflagrating upon initiation of at least one of the initiation devices 205, 235. Referring now to FIG. 19, the burning transfer line 225 initiates the booster 1905, which, in turn, initiates the acceptor 1910. The acceptor 1910 detonates the linear shaped charge assembly 1705. In one embodiment, the booster 1905 comprises a more energetic material than the transfer line 225, and the acceptor 1910 comprises a more energetic material than the booster 1905. Thus, the deflagration produced by the deflagrating transfer line 225 is amplified by the booster 1905, and is further amplified by the acceptor 1910. In this way, a detonation wave of sufficient amplitude to detonate the linear shaped charge 1902 is generated.

Figure 20:
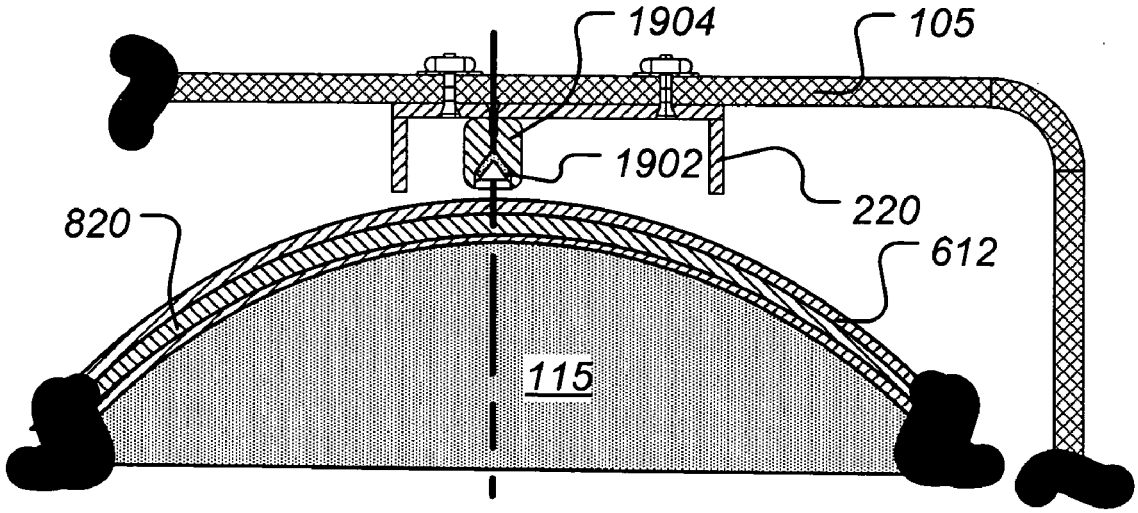
FIG. 20 is a cross-sectional view of a portion of the munition 100 and the canister illustrating the mounting of the linear shaped charge.

FIG. 20 provides a cross-sectional view of a portion of the munition 100 and the canister 105. In the illustrated embodiment, the holder 1904 is mounted to the case 105 via the bracket 205. The linear shaped charge 1902 is positioned at a desired standoff from the munition, as discussed above in relation to FIG. 8.

FIG. 21 provides a cross-sectional view of a fourth embodiment of the present invention. In this embodiment, the thermally-activated initiation and detonation capabilities of each of the first three embodiments are incorporated into a single device. A venting device 2100, in the illustrated embodiment, comprises an initiation device 2105 coupled with a linear shaped charge 2110. The initiation device 2105 comprises a pyrotechnic train 2115, disposed within a housing 2117, that is adapted to initiate at a desired temperature or within a range of desired temperatures to detonate the linear shaped charge 2110.

In the illustrated embodiment, the pyrotechnic train 2115 comprises a heat-sensitive deflagration charge 2120 that is inactive below the predetermined propellant safety temperature and is activated above the propellant safety temperature or within a range of temperatures above the propellant safety temperature. Alternatively, the deflagration charge 2120 may be inactive below a predetermined minimum munition exhaust temperature and is activated above the minimum munition exhaust temperature or within a range of temperatures above the minimum munition exhaust temperature. In various embodiments, the deflagration charge 2120 may comprise materials such as, but not limited to, $CS_2B_{12}H_{12}/BKNO_3$, lead azide, hexanitrostilbene (HNS), and ammonium perchlorate.

The initiation device 2105 further comprises a deflagration to detonation transition charge 2125, which may comprise materials such as, but not limited to, $Cs_2B_{12}H_{12}/BKNO_3$, lead azide, hexanitrostilbene (HNS), and ammonium perchlorate, which may have a higher density than the deflagration charge 2120. The transition charge 2125 amplifies the deflagration produced by the deflagration charge 2120 to a detonation wave. The transition charge 2125 comprises a material that is more energetic than the deflagration charge 2120, such as, but not limited to, $CS_2B_{12}H_{12}/BKNO_3$, lead azide, hexanitrostilbene (HNS), and ammonium perchlorate, which may have a higher density than the transition charge 2125. The initiation device 2105 further comprises a booster 2130 that amplifies the detonation wave produced by the detonated transition charge 2125 to a level sufficient to detonate the linear shaped charge 2110. The munition 100 is thus vented by the detonated linear shaped charge 2110, as described above concerning the previous embodiments.

While the pyrotechnic train 2115 illustrated in FIG. 21 comprises three pyrotechnic components (i.e., the deflagration charge 2120, the transition charge 2125, and the booster 2130), the present invention is not so limited. Rather, the pyrotechnic train 2115 may comprise fewer pyrotechnic components or more pyrotechnic components than illustrated in FIG. 21, depending upon the pyrotechnic materials chosen for the pyrotechnic train 2115 and the explosive material used in the linear shaped charge 2110.

FIG. 22 provides a cross-sectional view of a fifth embodiment of the present invention. A venting device 2200, in the illustrated embodiment, comprises an initiation device 2203 coupled with a linear shaped charge 2210. The initiation device 2203 comprises a heat-sensitive propelling charge 2205 disposed within a cavity 2210 of a housing 2215. The material comprising the propelling charge 2205 is chosen to be inactive below the predetermined propellant safety temperature and is activated above the propellant safety temperature or within a range of temperatures above the propellant safety temperature. Alternatively, the propelling charge 2205 may be inactive below a predetermined minimum munition exhaust temperature and is activated above the minimum munition exhaust temperature or within a range of temperatures above the minimum munition exhaust temperature. In various embodiments, the propelling charge 2205 may comprise materials such as $Cs_2B_{12}H_{12}/BKNO_3$, lead azide, hexanitrostilbene (HNS), and ammonium perchlorate.

Also disposed in the cavity 2210 is a firing pin 2220 held in place by a shear pin 2225, a cartridge 2230, a deflagration-to-detonation transition charge 2235, and a booster 2240. In operation, gases produced by the activated propelling charge 2120 urge the firing pin 2220 toward the cartridge 2230 with sufficient force to fail the shear pin 2225. The firing pin 2220 then impacts and initiates an energetic material within the cartridge 2230. The deflagrating cartridge 2230 initiates the transition charge 2235, producing a detonation wave that, in turn, detonates the booster 2240. The detonated booster 2240 produces a detonation wave of sufficient intensity to detonate the linear shaped charge 2210. The munition 100 is thus vented by the detonated linear shaped charge 2110, as described above concerning the previous embodiments.

Generally, the booster 2240 comprises a more energetic material than the transition charge 2235, which comprises a more energetic material than that of the cartridge 2230. In various embodiments, the cartridge 2230 and the transition charge 2235 may comprise a material such as $Cs_2B_{12}H_{12}/BKNO_3$, lead azide, hexanitrostilbene (HNS), and ammonium perchlorate. Particular materials may be chosen based on their relative energetic properties. Alternatively, the same material may be chosen for each of the cartridge 2230 and the transition charge, such that the density of the transition charge 2235 is greater than that of the energetic material of the cartridge 2230. Further, the booster 2240 may comprise a material such as CH-6 or other such explosive.

While the initiating device 2203 illustrated in FIG. 22 comprises four pyrotechnic components (i.e., the propelling charge 2205, the cartridge 2230, the transition charge 2235, and the booster 2240), the present invention is not so limited. Rather, the initiating device 2203 may comprise fewer pyrotechnic components or more pyrotechnic components than illustrated in FIG. 22, depending upon the pyrotechnic materials chosen and the explosive material used in the linear shaped charge 2210.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An apparatus, comprising:

a thermally-activated, deflagration initiation device;

a deflagration-to-detonation transition manifold;

a first transfer line connecting the deflagration initiation device and the deflagration-to-detonation transition manifold; and a linear shaped charge coupled with the transition manifold;

wherein the first transfer line comprises:

a rapid deflagrating cord.

2. An apparatus, according to claim 1, further comprising:

a second transfer line connecting the deflagration-to-detonation transition manifold and the linear shaped charge.

3. An apparatus, according to claim 2, wherein the second transfer line comprises:

a shielded mild detonating cord.

4. An apparatus, according to claim 2, further comprising:

a release joint disposed between the second transfer line and the linear shaped charge.

5. An apparatus, according to claim 4, wherein the release joint comprises:

a detonating cord booster disposed proximate the second transfer line and an acceptor disposed between the booster and the linear shaped charge.

6. An apparatus, according to claim 4, wherein the release joint comprises:

an outer portion and an inner portion slidingly engaged with the outer portion, such that the outer portion and the inner portion may be engaged or disengaged via an applied load.

7. An apparatus, according to claim 1, further comprising:

a disabling, thermally-activated, deflagration initiation device connected to the deflagration-to-detonation transition manifold via the first transfer line.

8. An apparatus, according to claim 7, wherein the disabling initiation device further comprises:

a deflagrating charge and a pyrotechnic delaying portion disposed between the deflagrating charge and the first transfer line.

9. An apparatus, according to claim 1, wherein the transition manifold comprises:

a first booster comprising a material that is more energetic than that of the first transfer line and a second booster comprising a material that is more energetic than that of the first booster.

10. An apparatus, according to claim 1, further comprising:

a canister; and a munition disposed in the canister, wherein:

the thermally-activated, deflagration initiation device is operably associated with the canister; and the linear shaped charge is operably associated with the munition.

11. An apparatus, comprising:

a thermally-activated, deflagration initiation device;

a deflagration-to-detonation transition manifold;

a first transfer line connecting the deflagration initiation device and the deflagration-to-detonation transition manifold;

a linear shaped charge; and a second transfer line connecting the deflagration-to-detonation transition manifold and the linear shaped charge;

wherein the second transfer line comprises:

a shielded mild detonating cord.

12. An apparatus, comprising:

a thermally-activated, deflagration initiation device;

a deflagration-to-detonation transition manifold;

a first transfer line connecting the deflagration initiation device and the deflagration-to-detonation transition manifold;

a linear shaped charge;

a second transfer line connecting the deflagration-to-detonation transition manifold and the linear shaped charge; and a release joint disposed between the second transfer line and the linear shaped charge.

13. An apparatus, according to claim 12, wherein the release joint comprises:

a detonating cord booster disposed proximate the second transfer line and an acceptor disposed between the booster and the linear shaped charge.

14. An apparatus, according to claim 12, wherein the release joint comprises:

an outer portion and an inner portion slidingly engaged with the outer portion, such that the outer portion and the inner portion may be engaged or disengaged via an applied load.

15. An apparatus, comprising:

a thermally-activated, deflagration initiation device;

a deflagration-to-detonation transition manifold;

a first transfer line connecting the deflagration initiation device and the deflagration-to-detonation transition manifold;

a linear shaped charge coupled with the transition manifold; and a disabling, thermally-activated, deflagration initiation device connected to the deflagration-to-detonation transition manifold via the first transfer line.

16. An apparatus, according to claim 15, wherein the disabling initiation device further comprises:

a deflagrating charge and a pyrotechnic delaying portion disposed between the deflagrating charge and the first transfer line.

17. An apparatus, according to claim 15, further comprising:

a second transfer line connecting the deflagration-to-detonation transition manifold and the linear shaped charge.

18. An apparatus, according to claim 17, further comprising:

a release joint disposed between the second transfer line and the linear shaped charge.

19. An apparatus, comprising:

a thermally-activated, deflagration initiation device;

a deflagration-to-detonation transition manifold;

a first transfer line connecting the deflagration initiation device and the deflagration-to-detonation transition manifold; and a linear shaped charge coupled with the transition manifold;

wherein the transition manifold comprises:

a first booster comprising a material that is more energetic than that of the first transfer line and a second booster comprising a material that is more energetic than that of the first booster.

20. An apparatus, according to claim 19, further comprising:

a second transfer line connecting the deflagration-to-detonation transition manifold and the linear shaped charge.

21. An apparatus, according to claim 20, further comprising:

a release joint disposed between the second transfer line and the linear shaped charge.

* * * * *